US005132670A

United States Patent [19]

Miller

[11] Patent Number: 5,132,670

[45] Date of Patent: Jul. 21, 1992

[54] SYSTEM FOR IMPROVING TWO-COLOR DISPLAY OPERATIONS

[75] Inventor: Merlin R. Miller, Aloha, Oreg.

[73] Assignee: Tektronix, Inc., Wilsonville, Oreg.

[21] Appl. No.: 428,442

[22] Filed: Oct. 30, 1989

Related U.S. Application Data

[63] Continuation of Ser. No. 895,410, Aug. 11, 1986, abandoned.

[51] Int. Cl.[5] ..... G09G 1/28

[52] U.S. Cl. ..... 340/703; 340/701; 340/799

[58] Field of Search ..... 340/701, 702, 703, 750, 340/799; 358/28; 382/47, 56

[56] References Cited

U.S. PATENT DOCUMENTS

| | | | |
|---|---|---|---|
| 4,520,356 | 5/1985 | O'Keefe et al. | 340/750 |
| 4,554,538 | 11/1985 | Bieneman | 340/799 |
| 4,580,134 | 4/1986 | Campbell et al. | 340/703 |
| 4,580,135 | 4/1986 | Kummer et al. | 340/703 |
| 4,646,077 | 2/1989 | Culley | 340/799 |
| 4,648,050 | 3/1987 | Yamagami | 340/703 |
| 4,677,427 | 6/1987 | Komatsu et al. | 340/703 |
| 4,888,582 | 12/1989 | Schnarel | 340/703 |

*Primary Examiner*—Ulysses Weldon
*Assistant Examiner*—M. Fatahiyar
*Attorney, Agent, or Firm*—Robert S. Hulse; Francis I. Gray

[57] ABSTRACT

A system is disclosed which reduces significantly the time for processing multi-bit two-color data for display. The system generates multi-bit two-color data by expanding single-bit monochromatic data, and provides three types of output data: a first expanded multi-bit color data, a second expanded multi-bit color data, and a third unchanged multi-bit data, the unchanged data being combinable with other data for producing data overlays.

The system comprises a data expansion circuit for maintaining selected data unchanged and for expanding selected single-bit data to multi-bit two-color data, a memory for storing multi-bit data, and a data compression circuit for compressing selected multi-bit data to single-bit data.

5 Claims, 7 Drawing Sheets

SYSTEM FOR IMPROVING TWO-COLOR DISPLAY OPERATIONS

This is a continuation of application Ser. No. 06/895,410 filed Aug. 11, 1986 and now abandoned.

BACKGROUND OF THE INVENTION

The present invention relates to graphic display systems generally, and particularly to digital circuits for controlling multi-bit color data when displaying color images in a raster scan CRT (cathode ray tube) display system.

In a typical monochromatic CRT display system, data bits stored in memory are mapped to the CRT screen, one bit per pixel or image element of the screen. The bit may be zero (off) representing black, or one (on) representing white.

In a typical color system, multiple bits rather than a single bit may be mapped to each pixel, each multiple representing a selected (predetermined) color value.

In such systems, two color states (e.g., a first color state and a second color state) may be specified for each pixel. Generally, however, such two-color systems do not provide for overlaying images in an efficient manner, i.e., for changing the color of selected pixels of an image and displaying (superimposing) the changed image over a previously unchanged version of the image, without requiring the system to perform additional time-consuming operations.

In one color system (see, for example, U.S. Pat. No. 4,888,582 issued to Schnarel, and incorporated in part herein), single bits are used in conjunction with multiple bits to specify color changes. The single bits are used as pixel control bits and the multiple bits as pixel color values. A single bit state of one indicates that a change is to be made in the color value of a pixel, whereas a single bit state of zero indicates that no change is to be made. Unlike two-color systems with first and second color features and no overlay feature, this system may be best described as a one-color system with overlay, the overlay being provided at the expense of the second color feature.

What is needed and would be useful therefore is an efficient two-color change system with overlay capability.

SUMMARY OF THE INVENTION

Accordingly, a multi-bit per pixel display system is provided which is not only capable of displaying multicolor images, but of doing so at substantially the efficiency or speed of monochromatic (single bit) systems, when one-color or two-color display mode is specified. The system is capable of operating in non-expansion mode (data mode), or in expansion mode (one-color pixel mode or two-color pixel mode). Ordinarily sixteen bits of data are processed at a time. In data mode the sixteen bits are treated as four four-bit pixel color values, whereas in the one-or two-color pixel mode, each bit is treated as a pixel control bit.

During one-color and two-color modes of operation, the system provides for storage of multi-bit pixel data in response to input of single-bit pixel data from a processor. This is accomplished by data expansion and the writing of the expanded data to memory. The system also provides for reading the multi-bit data from memory, compressing the multi-bit data to single-bit data, and outputting single-bit data to the processor. During two-color operation, each single bit may be expanded into a four-bit color value chosen from any of two predetermined color values.

The system comprises a data expansion apparatus responsive to applied data (including sixteen-bit pixel data and control data) for expanding the data, a frame buffer memory for storing expanded data, and a data compression apparatus for compressing the expanded data. The expansion apparatus includes two write registers for storing two four-bit pixel color values, a write-enable means and two multiplexers for sequentially selecting pixel control data, and color values from the registers, and passing the control data and color values to memory for storage. The expansion apparatus also includes a latch circuit for routing data from memory to its multiplexers, enabling the multiplexers to select and restore to memory, all color values that are to remain unchanged.

DETAILED DESCRIPTION OF THE INVENTION

The present invention represents an improvement over prior art systems. (Refer, for example, to the prior art one-color apparatus of Schnarel mentioned herein). For purposes of clarity and ease in understanding how the present invention operates, it is described in the context of Schnarel's one color apparatus with overlay feature.

One-Color Apparatus with Overlay Feature

Figure 1:
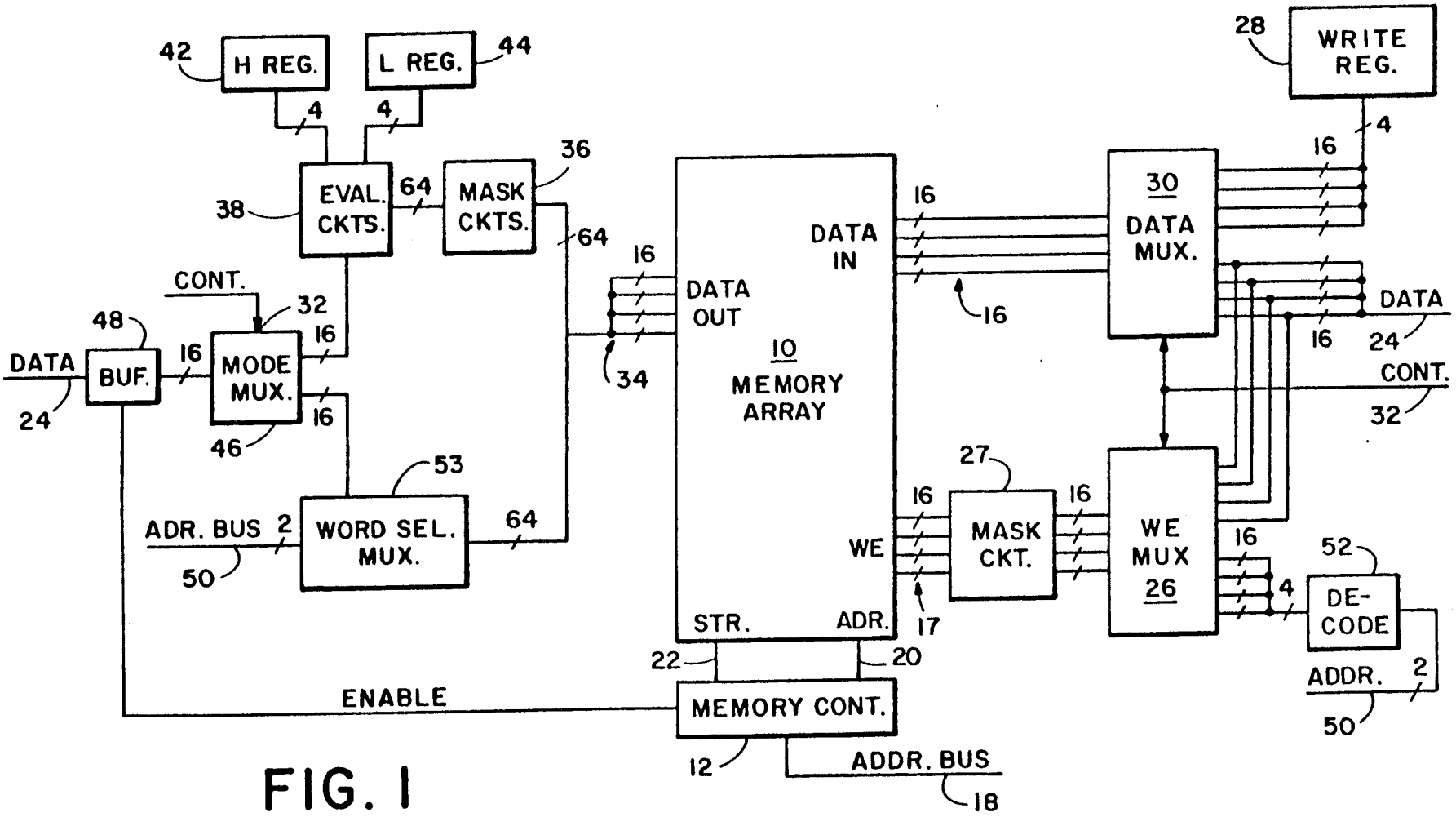
FIG. 1 (PRIOR ART)
FIG. 1 is a block diagram of an apparatus according to the prior art.

Referring to FIG. 1, an apparatus for storing multi-bit pixel data, illustrated in block diagram form, is adapted to store 16 four bit pixels in a 64 bit word at each memory location of memory array 10, the array having one data input, one write enable (WE) input, and one data output for each bit of a 64 bit memory word, currently addressed by memory controller 12. In order to write to any bit in memory array 10, the bit is placed on a corresponding data input line 16, a corresponding write enable input is energized by an associated write enable line 17, the memory address is placed on address bus 18, the appropriate addressing signals are placed on memory control lines 20 by memory controller 12, and finally, memory array 10 is strobed by a write signal from memory controller 12 via write strobe line 22.

The bit-mapping system of the present invention allows a processor (not shown) to read and write pixel data to memory array 10 in either of two modes: a "pixel" mode or a "data" mode. In the data mode, the processor may, during one read (or write) cycle, read (or write) four selected pixels from (or into) any addressed memory location. In the pixel mode, the processor may, during any one read cycle, determine which of the 16 pixels at any one memory address conform to selected bit patterns and may, during any one write cycle, write any selected pixel at a selected memory address to conform to a selected bit pattern.

To implement the write feature of the pixel mode, a data expansion mechanism is provided, whereby each line in a sixteen bit data bus 24 is linked in parallel to corresponding write enable inputs WE of memory array 10 through masking circuit 27 and through write enable multiplexer 26, when switched to a pixel mode state by a signal on mode control line 32. Masking circuit 27 is described in more detail hereinbelow. Each output line of a four bit, "write" register 28, is connected in parallel to corresponding data input terminals of the 16 currently addressed pixels by data input multiplexing means 30, when also switched to a pixel mode state by a signal on mode control line 32. (Control line 32 may comprise a portion of address lines 18 not otherwise used to address memory array 10.) Thus, during a pixel mode write cycle, the four data bits in write register 28 will be written to every pixel, at the current memory address, whose corresponding write enable input has been energized by a bit on the data bus 24.

Assuming that pixel data represents the color of a pixel, the display may be updated one color at a time. The processor stores, in write register 28, a four bit code representing the selected color, and then places a sixteen bit word on data bus 24 with each high bit in the word representing a pixel to be changed to the selected color, and with each low bit in the data word representing a pixel to remain unchanged. The appropriate memory address is then placed on the address bus 18, and the memory is strobed by memory controller 12, causing the four bit code in write register 28 to replace the pixel data corresponding to the selected pixels at the selected address. Thus up to sixteen four bit pixels may be changed in a single write cycle, the processor using only one data bit to control the state of each pixel. Further, since a low bit on the data line causes a corresponding pixel to remain unchanged during a write strobe, it is not necessary for the processor to read and then rewrite the unchanged pixel data when changing the value of other pixels at the same memory address.

To implement the read feature of the pixel mode, a data compression mechanism is provided wherein the 64 data output lines 34 of the memory array are grouped into 16 sets of four lines, such that each line of a set carries one of the four bits of a pixel at the current memory address. Each set of four data lines is applied to an associated masking circuit 36 which may be configured to transmit the four bit data to an associated evaluation circuit 38. The purpose of masking circuit 36 is also described in more detail hereinbelow.

Each of the 16 evaluation circuits 38 determines if the value of the applied pixel data falls within limits set by the processor. The upper limit (designated by variable H) is stored in H limit register 42 while the lower limit (L) is stored in L limit register 44. Each evaluation circuit 38 produces a single bit output indicating the results of the evaluation. The sixteen single bit outputs of the 16 evaluation circuits are transmitted through mode multiplexer 46, when switched to the pixel mode by a signal on control line 32, to data buffer 48. Buffer 48 places the evaluation data on data bus 24 when enabled by memory controller 12 during a read cycle.

Figure 2:
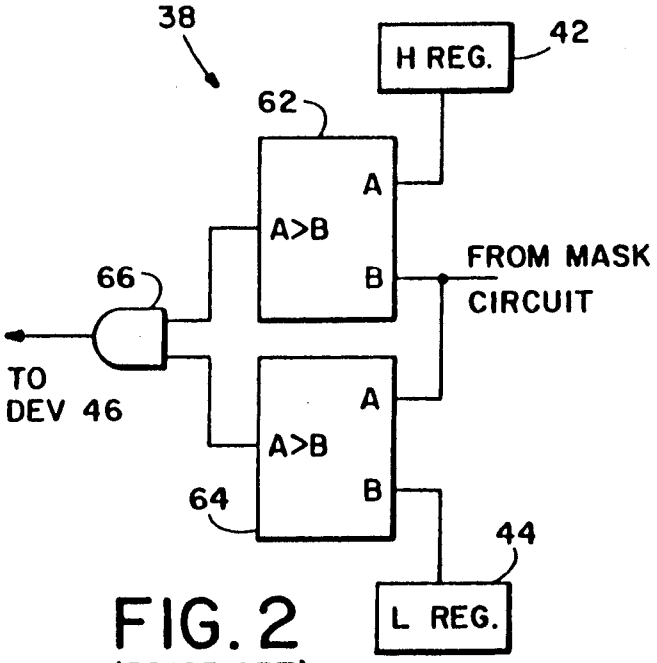
FIG. 2 (PRIOR ART)
FIG. 2 is a block diagram showing the data evaluation circuit of the apparatus of FIG. 1 in greater detail.

Evaluation circuit 38, depicted in more detail in FIG. 2, includes a pair of four bit comparators 62 and 64, each having four bit inputs A and B, and each producing a single bit output signal whenever the value of the A input exceeds the value of the B input. The data in H limit register 43 is applied to the A input of comparator 62 while the data in L limit register 44 is applied to the B input of register 64. The pixel data from masking circuit 36 is applied to the A input of comparator 64 and to the B input of comparator 62. The outputs of comparators 62 and 64 are summed by AND gate 66 to produce the compressed, single bit representation of the pixel, whenever the value of the applied pixel data lies between the values of the data stored in registers 42 and 44.

Figure 3:
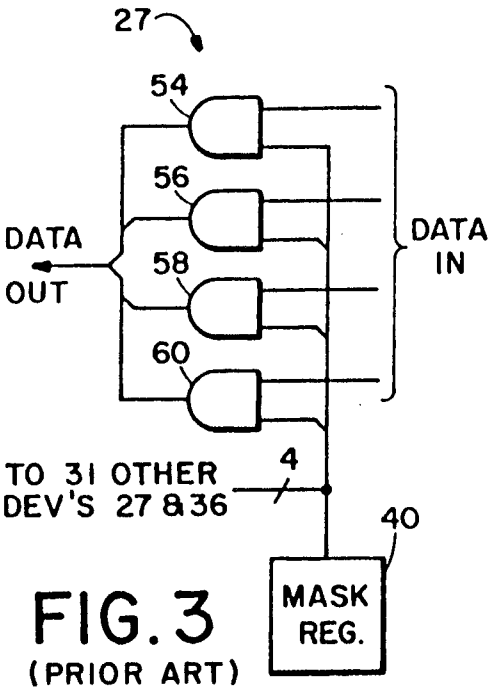
FIG. 3 (PRIOR ART)
FIG. 3 is a block diagram showing the masking circuit of the apparatus of FIG. 1 in greater detail.

Masking circuits 27 and 36 are identical and are depicted in more detail in block diagram form in FIG. 3. Each masking circuit comprises 16 groups of four AND gates (54, 56, 58 and 60) with each group of AND gates corresponding to one pixel of a currently addressed 16 pixel word. One data bit associated with each bit of a pixel is applied to one input of each corresponding AND gate. Mask register 40 stores a four bit code, previously loaded therein by a controlling processor, and has one data output line associated with each of the four stored data bits. Each data output line of register 40 is connected in parallel to one AND gate of each group of four AND gates in each of the 16 masking circuits 27 and to one AND gate of each group of 16 masking circuits 36. If each of the four bits in register 40 is in logical state "1", then the data outputs of AND gates 54, 56, 58 and 60 are equal to their corresponding pixel data inputs. If any one of the bits stored in register 40 is a logical "0", then the output of the corresponding AND gate is a 0 regardless of the corresponding pixel data input.

By selectively loading 0's into one or more of the four bit storage cells of mask register 40, with 1's loaded into the remaining bits, corresponding bits of each currently addressed pixel may be "masked" such that these bits remain unchanged during a memory write operation, regardless of the data on data bus 24 because corresponding write enable inputs are deactivated. Similarly, by selectively loading 0's into one or more of the four cells of register 40, corresponding bits of each currently addressed pixel may be masked during a read operation such that these bits are passed to evaluation circuit 38 as 0's regardless of the state of the associated pixel bit data received by masking circuit 36 from memory array 10 during a read cycle.

Assuming, by way of example, that the pixel data corresponds to the color of each pixel, and that the processor wishes to determine which pixels are of colors lying within a particular color range, the processor loads appropriate masking data into register 40 and appropriate limiting data into registers 42 and 44, such that each evaluation circuit 38 produces a high output data bit whenever the associated pixel color lies within the selected range. The pixel mode of memory access thus alleviates the need for the processor to perform logical operations on the pixel data to determine the color of the pixels, and allows the processor to manipulate the display using only one bit per pixel.

Assuming, by way of a second example, that the display is configured as a set of overlapping "surfaces" with each surface single bit-mapped onto one of four memory "planes" with bits from each plane collectively comprising a pixel, and that the processor wishes to determine which pixels contain bits illuminating a point on a particular surface, or set of surfaces, the processor may configure the data stored in registers 40, 42 and 44 such that each evaluation circuit 38 produces a high output data bit whenever the associated pixel contains a high (or low) bit (or bits) in the memory plane (or planes) of interest. The masking circuits alleviate the need for the processor to perform logical operations on the pixel data to determine the state of a particular display surface, and allows the processor to manipulate data regarding each surface using only one bit per pixel.

In the data mode, the data compression and expansion mechanisms used in the pixel mode are bypassed and the processor writes and reads data in and out of memory array 10 in a word-by-word fashion. During a data mode write cycle, data input multiplexing circuit 30 is switched by control line 32 to a data mode state to connect each line of data bus 24 in parallel to four corresponding data input lines 16 to memory array 10. When switched to the data mode by control line 32, write enable multiplexing circuit 26 controls the 64 write enable inputs of memory array 10 such that all of the write enable inputs of a selected subgroup of four pixels in a currently addressed group of 16 pixels are activated, while the write enable inputs of the other 12 pixels are deactivated.

Figure 4:
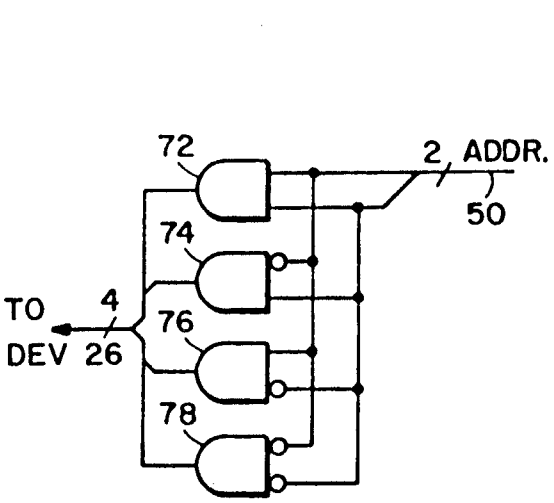
FIG. 4 (PRIOR ART)
FIG. 4 is a block diagram showing the decoding circuit of the apparatus of FIG. 1 in greater detail.

The subgroup to be write enabled is selected by an appropriate two bit code on control bus 50, which may be a part of address bus 18 not otherwise used to address memory array 10. Control bus 50 is applied to decoding circuit 52 which produces an output signal on one of four output lines depending on which of the four possible input signal combinations appear on the two lines of control line 50. Decoding circuit 52, shown in more detail in FIG. 4, comprises a set of four AND gates, 72, 74, 76, and 78, with the two lines of control bus 50 being applied in parallel to the two inputs of each AND gate. Opposite inputs of AND gates 74 and 76 are inverted, both inputs of AND gate 78 are inverted, and neither input of AND gate 72 is inverted. The output of each AND gate is placed in a high state by a unique combination of states on the lines of control bus 50 and comprise the four outputs of decoding circuit, each AND gate output being applied in parallel to 16 inputs of write enable multiplexer 24.

To write to the selected group of four pixels while in the data mode, the appropriate masking code is placed in masking register 40 of mask circuit 27, the 16 bit data is placed on data bus 24, the appropriate data mode bit is placed on control line 32 (to switch circuits 26 and 30 to the data mode), and array 10 is write strobed by control line 22 with the correct address on address bus 18.

During a data mode read cycle, word selecting multiplexer circuit 53 transmits one selected 16 bit word, of the four 16 bit data words appearing on the 64 data output lines 34, to data output multiplexing circuit 46, with the selection being controlled by data appearing on lines 50 from the microprocessor. With multiplexer 46 switched to the data mode by control line 32, the selected data word from circuit 53 is passed to buffer 48, for placing the selected word on data bus 24 when enabled by memory control circuit 12.

Two-Color System with Overlay Feature

Figure 5:
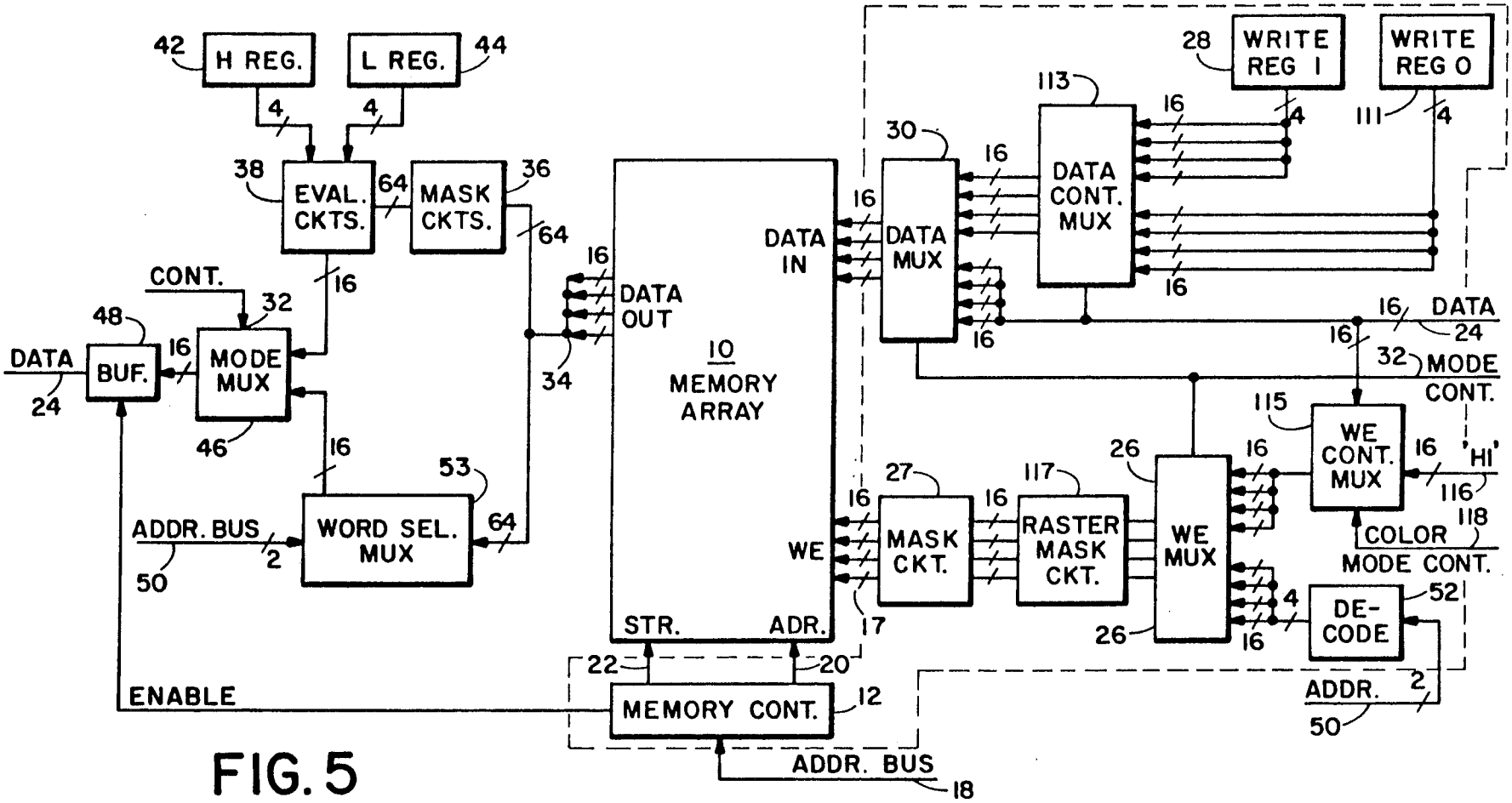
FIG. 5 is a block diagram of a system according to the present invention.

Referring now to FIG. 5, there is shown a system of the present invention for performing two-color operations, with and without overlay, in an efficient manner (i.e., without the inefficiency of prior multi-bit one color systems which require the performance of a time-consuming erase operation when generating new images without overlay).

In addition to the block elements shown in FIG. 1, the system of the present invention includes a write register 111, as a second write register, a data control multiplexer 113, a write enable control multiplexer 115, a raster mask circuit 117 including a raster mask register 119, and coupled as shown in FIG. 5. The system of FIG. 5 allows a processor (not shown) to read and write pixel data to frame buffer memory array 10 in either of three modes: a one-color pixel mode, a two-color pixel mode, or a data mode. The one-color pixel mode and data mode operate as described hereinbefore.

In the two-color pixel mode, the processor stores in first write register 28 a first four-bit value, and in second write register 111 a second four-bit value, the first and second values representing first and second selected colors, respectively. The processor then places a sixteen bit data word on data bus 24, with each high bit in the data word representing a pixel whose value (in memory 10) is to be changed to the value in register 28, and each low bit in the data word representing a pixel whose value is to be changed to the value in register 111. Data control multiplexer 113 is coupled to receive pixel color values from registers 28 and 111, and processor data from data bus 24. Data control multiplexer 113 operates to pass color values from registers 28 and 111 to data multiplexer 30 in response to data values of one and zero, respectively, applied to multiplexer 113 from data bus 24. In one-color and two-color pixel modes, the data values serve as pixel color control values rather than as pixel color values.

Write enable control multiplexer 115 is coupled to receive processor data from data bus 24, high logic state inputs from line 116, and color mode control signals from line 118. As distinct from mode control line 32 which is used to distinguish between data mode and pixel mode, color mode control line 118 is used to distinguish between one-color pixel mode and two-color pixel mode. In response to a high signal level on line 118 (e.g., a one indicating one-color mode), multiplexer 115 operates to pass to multiplexer 26 data values from bus 24 when the system is in pixel mode. However, when the system is in pixel mode and the signal on line 118 is low (zero) indicating two-color mode, multiplexer 115 operates to pass to multiplexer 26 a high signal level (all ones corresponding to data on input line 116) on all of its output lines to multiplexer 26.

Figure 6:
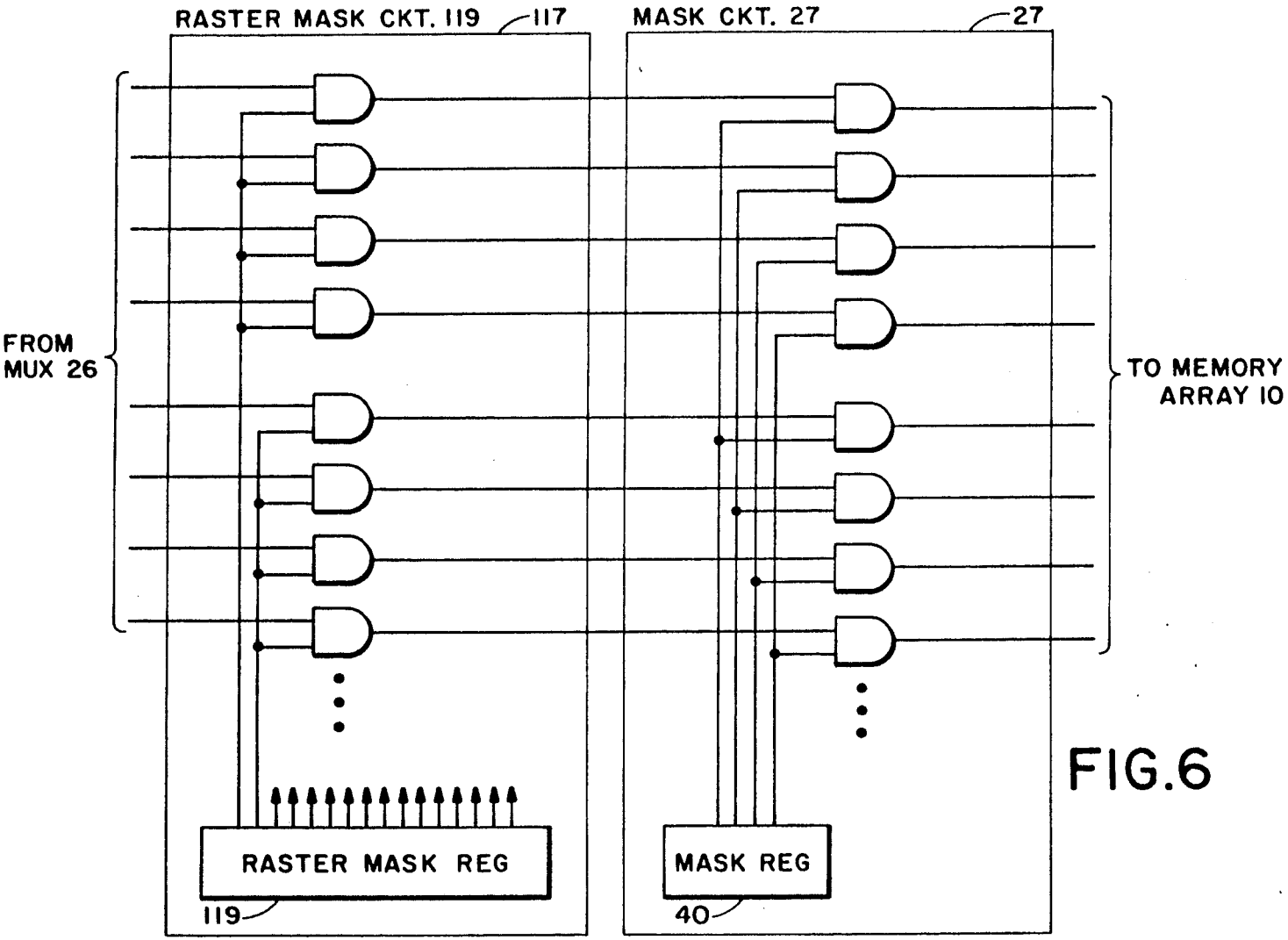
FIG. 6 is a block diagram showing the mask circuit and raster mask circuit of the system of FIG. 5 in greater detail.

As shown in FIGS. 5 and 6, the output of multiplexer 26 is applied to raster mask circuit 117 whose output is applied, in turn, to mask circuit 27. Like mask circuit 27 which includes a mask register 40 (FIG. 3), raster mask circuit 117 includes a raster mask register 119. As shown in FIG. 6, one bit of the mask in register 40 is used to control one bit (the same bit) for generating write enables for all pixels, whereas one bit of the mask in register 119 is used to control all bits for generating write enables for one pixel.

Figure 7:
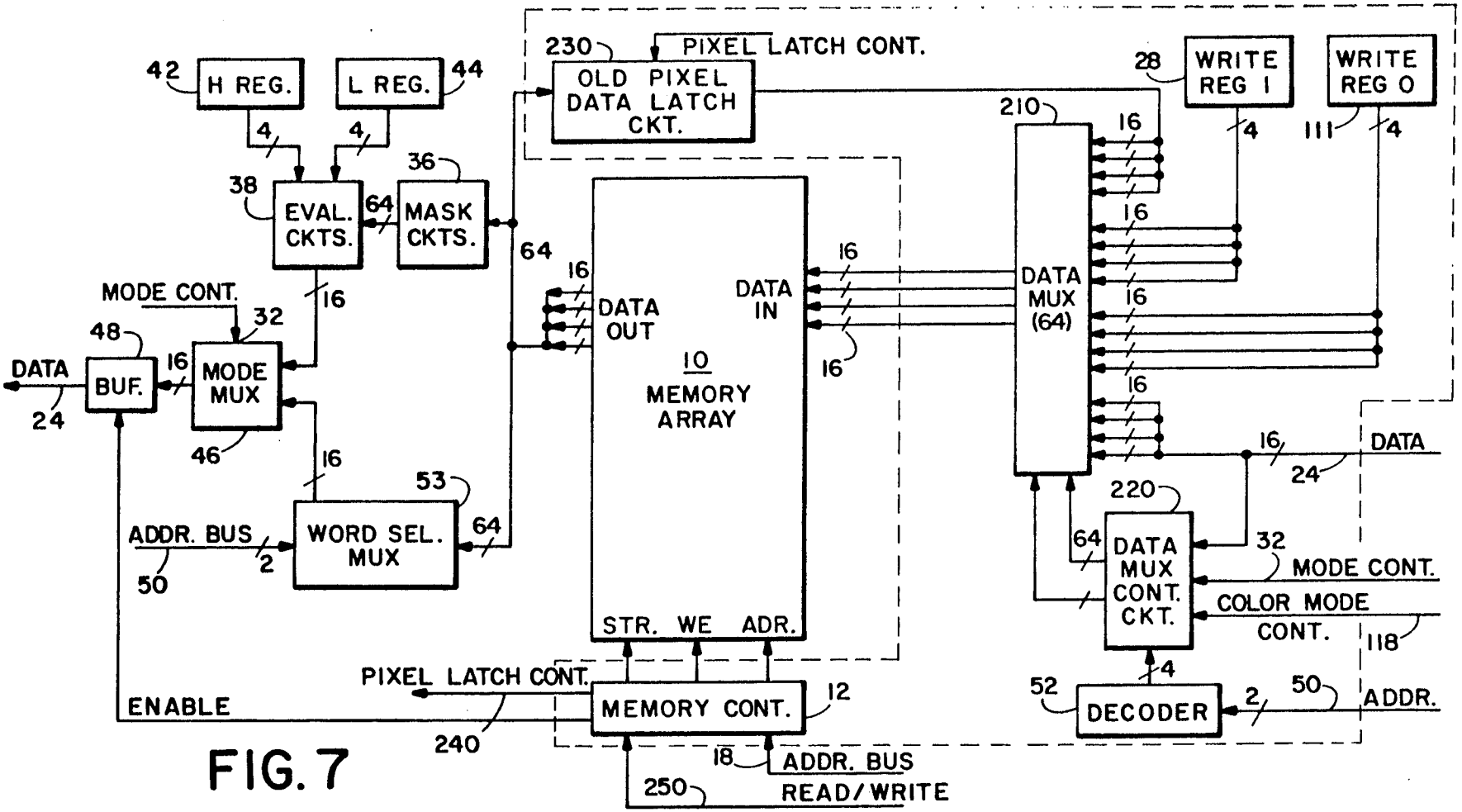
FIG. 7 is a block diagram of a system showing an alternative embodiment of the present invention.

An alternative embodiment of the present invention is shown in FIG. 7, where the change and no-change (overlay) of data stored in memory 10 is not accomplished by controlling the write enable signals to memory 10 as shown in FIGS. 1 and 5, but by effecting a read-modify-write (RMW) operation upon data stored in memory 10. This RMW operation is accomplished by causing all write operations to frame buffer memory 10 (i.e., write operations in any of the three modes: one-color pixel mode, two-color pixel mode, or data mode) to be performed first by reading the color values of selected groups of pixels from memory 10, storing (latching) the values in a latch circuit 230, then writing the latched color values back into memory 10 via data multiplexer 210 if a no-change condition is indicated by the values in the mask register, the values in the raster mask register, or by the pixel control values (data bus values) when in one-color pixel mode.

Data multiplexer 210 is a four-to-one multiplexer (i.e., four inputs to one output) whose sixty four output terminals are coupled to the sixty-four data input terminals of memory 10. Four groups of input data are applied to multiplexer 210. These include pixel color values from latch circuit 230, color values from registers 28 and 111, and pixel data from data bus 24. In response to control information from data multiplexer control circuit 220, data multiplexer 210 selects one of the four groups of input data and transfers the selected data to memory 10. The output of circuit 220 is applied to multiplexer 210 via sixty-four sets of two control lines. Each set of control lines is used to control the output of one of the sixty four bits (i.e., one bit of one of the sixteen pixels) from multiplexer 210 to memory 10. The two lines of each set provide four bits of information enabling selection of one of the four input data groups.

Figure 8:
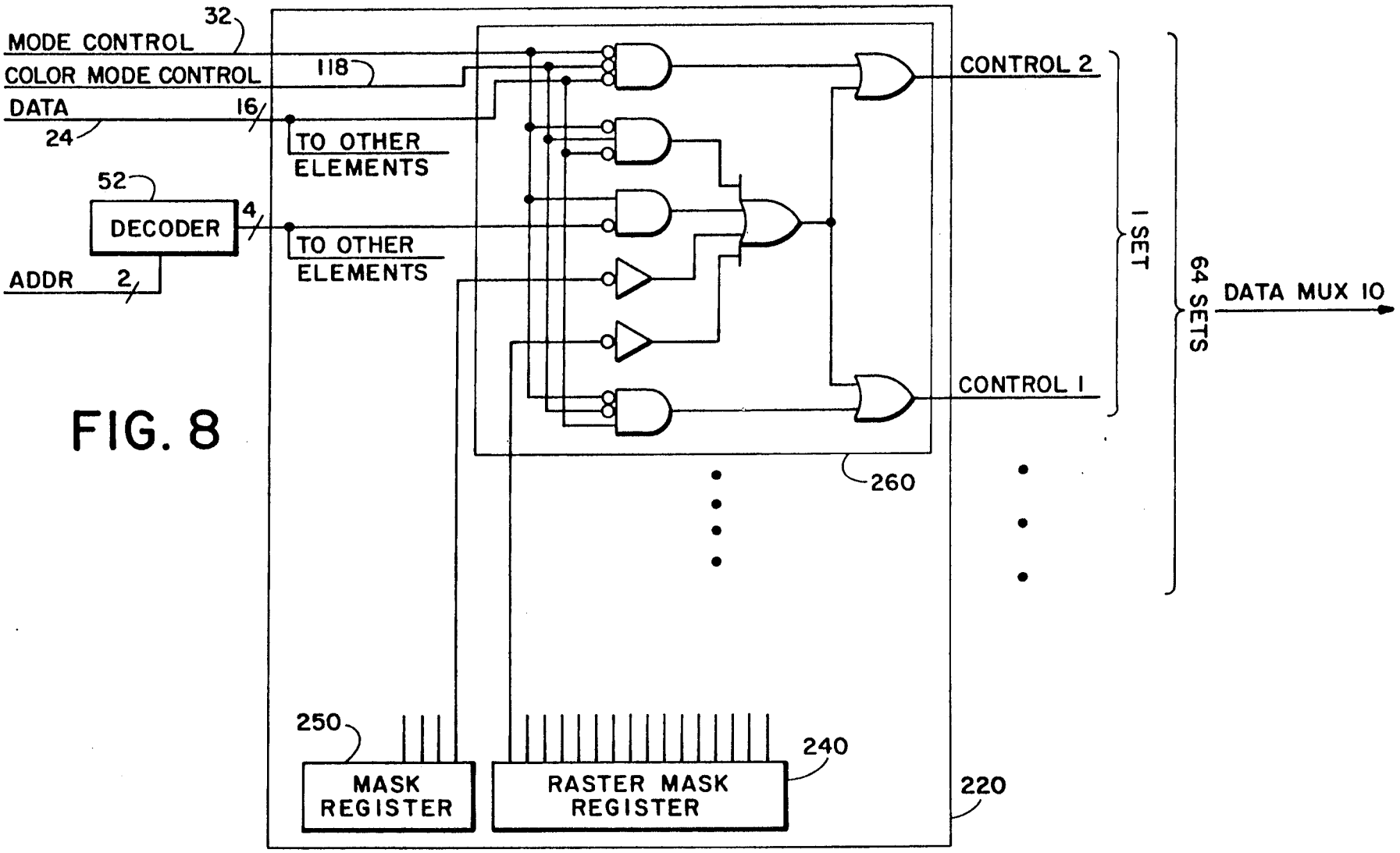
FIG. 8 is a block diagram of the data multiplexer control circuit of the system of FIG. 7 in greater detail.

Referring now to data multiplexer control circuit 220, the circuit includes, as shown in FIG. 7 and in greater detail in FIG. 8, a raster mask register 240, a mask register 250, and sixty-four combinatorial circuits such as circuits 260. The outputs from these combinatorial circuits are applied to multiplexer 210. The inputs to circuits 260 are data bus signals 24, masking information from registers 240 and 250, a pixel mode control signal 32 indicating pixel or data mode, a color mode control signal 118 indicating one-color or two-color pixel mode, and data from decoder 52 representing selected data mode outputs. Each circuit 260 receives as input one bit from bus 24, one bit from mask register 250, one bit from raster mask register 240, one bit from the decoded address bus, the pixel mode control signal and the color mode control signal. Circuits 260 produce on their sixty-four output lines, specific signal levels enabling data multiplexer 210 to transfer selected data to frame buffer memory 10. Each set of output control lines (control 1, control 2) exhibits one of four states (00, 01, 10, 11). State 00 (control 1=0 and control 2=0) enables data multiplexer 210 to transfer the inputs from data bus 24 to memory 10, state 01 enables pixel color value from register 111 to be transferred to memory 10, state 10 enables pixel color value from register 28 to be transferred to memory 10, and state 11 enables old pixel color values received by multiplexer 210 from memory 10 via latch circuit 230 to be transferred back to memory 10 thereby leaving the old pixel color values unchanged. Specifically, combinatorial circuit 260 creates output state 11, indicating old pixel color values, when the bit from mask register 250 indicates that the corresponding bit in memory 10 is not to be changed, or when the bit from raster mask register 240 indicates that the color value of the corresponding pixel is not to be changed, or when pixel mode control 32 and color mode control 118 indicates that the system is in the one-color mode of operation and a specific bit on data bus 24 is zero again indicating no change to the associated pixel. Circuit 260 creates the output state 00, indicating that selected bits from bus bits 24 are to be transferred to frame buffer memory 10 when the signal on pixel mode control line 32 indicates that the system is in data mode, and when the bit from mask register 250 indicates that the corresponding bit in memory 10 is enabled to be changed, and when the bit from raster mask register 240 indicates that the color value of the corresponding pixel is enabled to be changed. Circuit 260 creates the state 01, indicating that the value from register 111 is to be transferred to frame buffer memory 10, when the pixel mode control and color mode control signals indicate that the system is in two-color mode of operation, the corresponding bit from data bus 24 is zero, and the bits from raster mask register 240 and mask register 250 indicate that a change should be made. Circuit 260 creates the state 10, indicating that the value from register 28 is to be transferred to frame buffer memory 10, when the pixel mode control signal indicates that the system is in pixel mode, the corresponding bit from data bus 24 is a one, and the bits from raster mask register 240 and mask register 250 indicate that a change be made.

As shown in FIG. 7, memory controller 12 controls the address and control lines of frame buffer memory 10. Inputs to circuit 12 are a portion of address bus 18, and a read/write signal from the processor (not shown). The read/write signal indicates whether the access to memory 10 is to be performed as part of a read operation or write operation. A pixel latch control signal is produced by memory controller 12. This latch control signal is used during a read operation to enable pixel values to be read from memory 10 and latched into latch circuit 230. A selected portion of the latched pixel values is then transferred back to memory 10 through data multiplexer circuit 210 depending upon which pixels are selected to remain unchanged. Latch circuit 230 is a sixty-four bit latch. It is used for storing a selected data word (sixteen pixels of four bits each) from memory 10 before each write operation. Inputs to the latch circuit 230 are pixel latch control data from memory controller 12 and pixel color values from memory 10.

Figure 9:
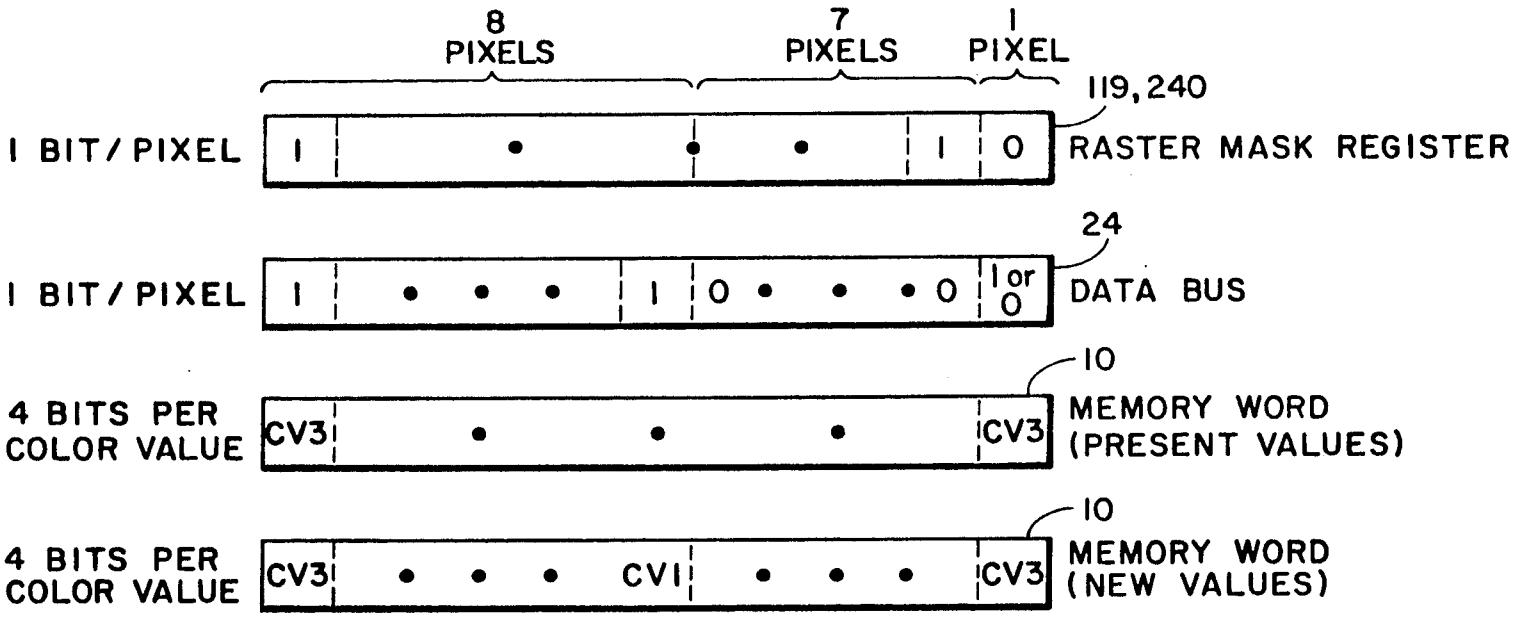
FIG. 9 is a block diagram showing an arrangement of data at selected elements of the system of FIG. 7.

FIG. 9 provides an example of the two-color change and overlay (no-change) operations of the system. Assume that a two-color, pixel mode operation is specified by appropriate control information on lines 118 and 32, and that first and second color values (CV1 and CV2) are stored in write registers 28 and 111. Further, assume that the present data in raster mask register 119 and 240, on data bus 24, and in a word in memory 10 are as shown in FIG. 9. Then, the fifteen "one bits" in the raster mask register will (upon operation of circuit 117 or 220) cause the corresponding fifteen pixel color values (CV3) in the memory word to be changed according to whether corresponding bits of data from the data bus are ones or zeros. Thus, because eight bits of data from the data bus are ones, eight corresponding pixel color values (CV3) are changed to the color value CV1; and since the seven bits of data from the data bus are zeros, seven corresponding pixel color values are changed to the color value CV2. Because a "zero bit" is specified in the raster mask register, no change is made in the corresponding pixel color value in the memory word; the pixel color value (CV3) is retained. Retention may be accomplished either by the non-write-enable operation of the system of FIG. 5 or the read-modify-write (latch) operation of FIG. 7.

I claim:

1. An apparatus for processing each bit of applied data and producing multi-bit pixel color data for display of a colored image comprising:

means for storing multi-bit pixel values, a plurality of pixels being stored at each addressable location of the storing means, said storing means having a data input for writing multi-bit pixel values to the currently addressed storage location and a data output for reading out the values of the pixels currently addressed;

means coupled to the data output of the storing means for latching data values of the pixels currently addressed;

means for selecting for each pixel from one of the contents of the latching means and outputs of registers containing multi-bit pixel color values according to a control word derived from the individual bits of the applied data to produce a new data word for input to the storing means for the pixels currently addressed.

2. The apparatus of claim 1, wherein the selecting means comprises:

means for converting the individual bits of the applied data into the control word as a function of a mask data word; and means for multiplexing the multi-bit pixel color values from the registers and the contents of the latching means in response to the control word to produce the new data word.

3. The apparatus of claim 2, wherein the converting means comprises:

programmable means for storing the mask data word; and means for logically combining the stored mask data word with the bits of the applied data to produce the control word.

4. The apparatus of claim 3, wherein the control word within the means for logically combining contains a plurality of sets of bits, each set of bits indicating for a separate one of the pixels currently addressed which one of the latched multi-bit pixel data value and separate multi-bit pixel color values output from the registers is to be contained in the new data word.

5. A method for processing each bit of applied data and producing multi-bit pixel data for display of a colored image represented in a memory by stored multi-bit pixel values, the method comprising the steps of:

identifying the memory address of pixels of the colored image to be modified, a plurality of pixels being stored at each addressable memory location;

latching data values for the pixels currently addressed; and selecting for each pixel from one of the latched the data values and outputs of registers containing multi-bit pixel color values according to a control word derived from the the bits of the applied data to produce a new data word for input to the memory for the pixels currently addressed.

* * * * *